US006905401B1

(12) United States Patent
Chen

(10) Patent No.: US 6,905,401 B1
(45) Date of Patent: Jun. 14, 2005

(54) BI-DIRECTIONAL ROTATION PNEUMATIC GRINDING TOOL

(75) Inventor: Lung-Hui Chen, Zhubei (TW)

(73) Assignee: Sunmatch Industrial Co., Ltd., Zhubei (TW)

( * ) Notice: Subject to any disclaimer, the term of this patent is extended or adjusted under 35 U.S.C. 154(b) by 0 days.

(21) Appl. No.: 10/840,301

(22) Filed: May 7, 2004

(51) Int. Cl.[7] ..... B24B 41/00
(52) U.S. Cl. ..... 451/342; 451/360; 451/359
(58) Field of Search ..... 451/342, 343, 451/344, 352, 359, 360; 30/388, 389, 390, 391; 83/651

(56) References Cited

U.S. PATENT DOCUMENTS 3,295,262 A * 1/1967 Brown ..... 451/344
5,406,752 A * 4/1995 Neff ..... 451/344
6,093,090 A * 7/2000 Tosto et al. ..... 451/342
6,813,837 B1 * 11/2004 Chen ..... 30/272.1
2004/0248505 A1 * 12/2004 Chen ..... 451/340

* cited by examiner

*Primary Examiner*—Dung Van Nguyen
(74) *Attorney, Agent, or Firm*—Birch, Stewart, Kolasch & Birch, LLP

(57) ABSTRACT

A bi-directional rotation pneumatic grinding tool for surface grinding operation consists of an operating section and a handgrip. The operating section includes an actuator to drive a transmission axle to rotate in two directions that has a spline section and a screw hole to couple with a first and a second splined trough of a coupling member and a fastening member, and a fastening element which has screw threads to run through the fastening member and fasten to the screw hole of the transmission axle. The invention may rotate in a positive or inverse direction to meet different requirements without loosening off. The design of spline section and splined troughs makes fabrication and assembly easier without concerning screwing direction. And sparks, grinding debris or dusts generated during grinding operation may be directed in a desired direction without polluting the working environment, hurting people, or damaging the work pieces.

3 Claims, 4 Drawing Sheets

BI-DIRECTIONAL ROTATION PNEUMATIC GRINDING TOOL

FIELD OF THE INVENTION

The present invention relates to a pneumatic grinding tool and particularly to a bi-directional rotation pneumatic grinding tool.

BACKGROUND OF THE INVENTION

There are many types of grinding machines. They mostly are designed for uni-rotation at low speed and high torque to treat rough surfaces. Depending on the surface to be treated, the grinding operation can be divided in plane grinding and side grinding. Because the grinding tools are designed in a versatile fashion, they are widely used in various industries such as iron works, machinery, wood working, mold fabrication, car and motorcycle repair shops, fiberglass, electronics and the like. By changing the grinding member of different granular sizes, they can perform many different functions such as polishing, rust removing, glue removing, grinding, wax polishing, rough edge trimming, drilling, etc.

As to the actuating section used in the conventional. uni-direction, low speed and high torque grinding machines, refer to FIG. 1 for an actuating section 1 for a conventional pneumatic grinding machine. It has a transmission axle 13 extended outwards from the actuating section 1. A bearing 14 is coupled on the transmission axle 13. The transmission axle 13 further is fastened to a coupling member 10 by screwing. The coupling member 10 has a through fastening hole 15. The coupling member 10 is fastened to a fastening member 11. When in use, a grinding member 12 is clamped and anchored between the coupling member 10 and the fastening member 11, and is driven by the transmission axle 13 to rotate at high speed in one direction. However, when in operation, the uni-rotation grinding machine set forth above generally will generate a lot sparks, grinding debris, powders or dusts. The sparks are scattered around and may cause fire when inflammable goods are held nearby. The dusts create pollution in the operation environment. The scattered debris seriously affects the health and safety of operators. As the conventional grinding machines rotate in one direction, when to process a narrow work piece or a comer, the handgrip design of the conventional grinding machine could make operation difficult and result in a portion of the surface or corners of the work piece not possible to be treated as desired. Operators have to change their operating postures. This could affect the grinding quality and produce detects. Moreover, when the grinding member 12 rotates at high speed, a greater torque often occurs to the exposed portion of the transmission axle 13. The transmission axle 13 receives uneven distribution of torque and might deform or even damage. All these inconveniences and problems reduce the product effectiveness and undercut marketing competitiveness.

SUMMARY OF THE INVENTION

The primary object of the invention is to solve the aforesaid disadvantages. The present invention provides a novel design for transmission axle which can rotate in a positive direction or an inverse direction so that the sparks, grinding debris, or dusts generated during grinding operation may be directed in a desired direction to avoid creating pollution in the working environment or harmful effects to operators and work pieces.

Another object of the invention is to provide a transmission axle with a spline section that may be fabricated easily without concerning the screwing direction occurred to the conventional structure.

Yet another object of the invention is to allow the torque to be evenly applied on the fastening member to prevent deformation or damage thereof resulting from uneven torque distribution.

The bi-directional rotation pneumatic grinding tool according to the invention includes an operating section and a handgrip. The operating section includes:

an actuator to drive a transmission axle to rotate in two directions. The transmission axle has a spline section and a screw hole formed on the spline section;

a coupling member which has through openings on two ends. One end has a coupling section with a first splined trough formed therein to couple with the spline section of the transmission axle;

a fastening member which has through openings on two ends. One end has a second splined trough formed on an inner wall and may be inserted into the coupling member to couple with the spline section of the transmission axle; and a fastening element which has screw threads and runs through the fastening member to be fastened to the screw hole of the transmission axle.

Because the transmission axle is designed with the spline section, the problems occurred to the conventional techniques may be overcome.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
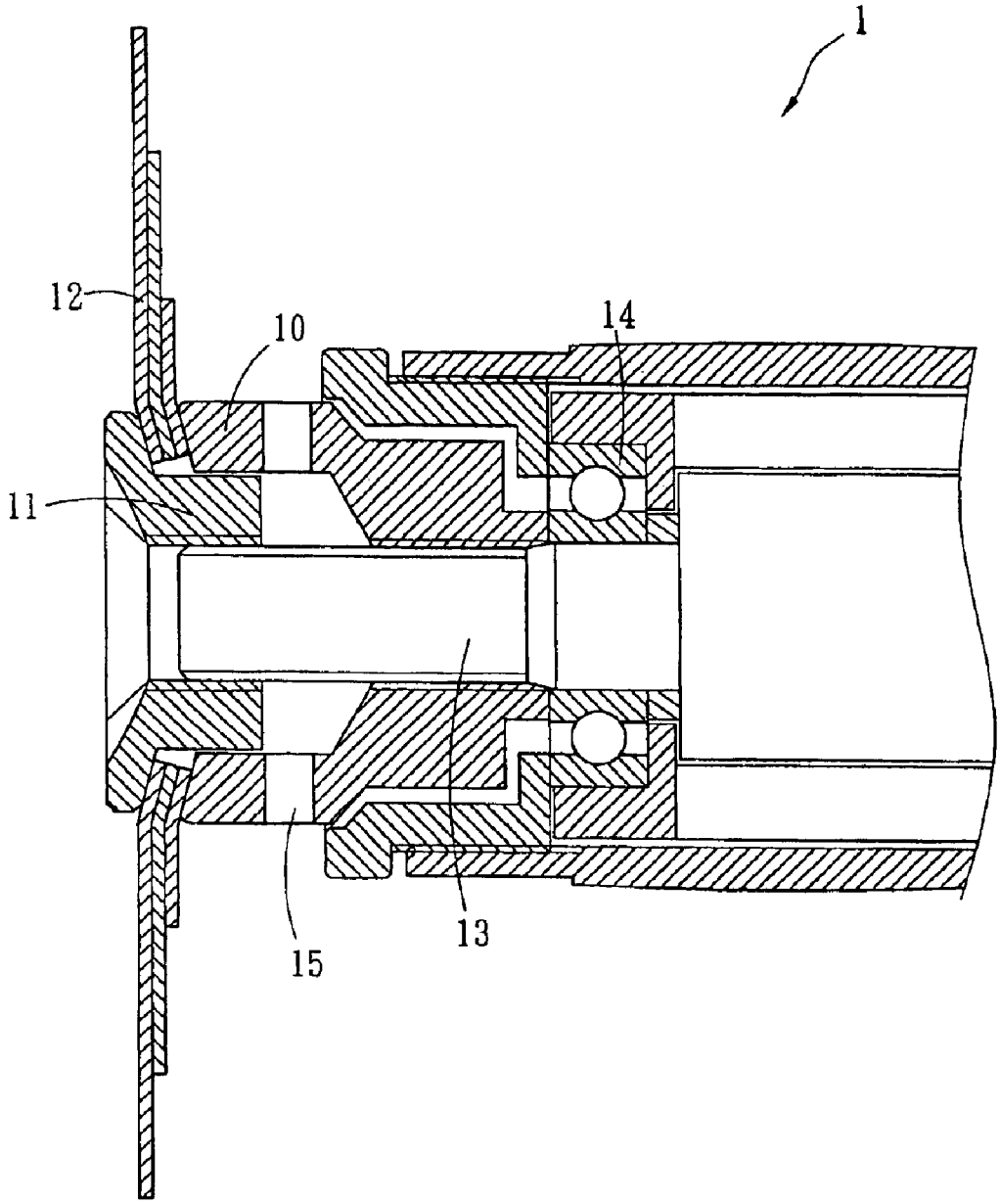
Fig. 1 PRIOR ART
FIG. 1 is a fragmentary sectional view of the operating section of a conventional pneumatic grinding tool.
Figure 2:
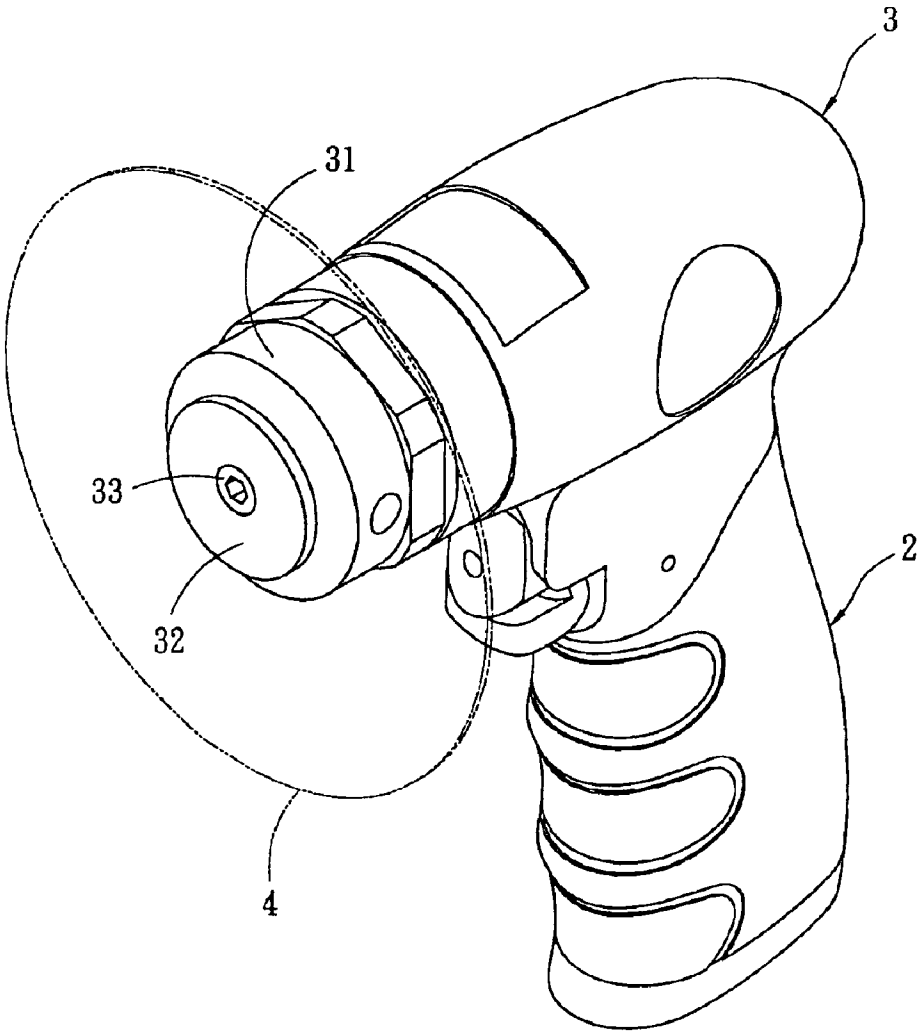
FIG. 2 is a perspective view of the present invention.
Figure 3:
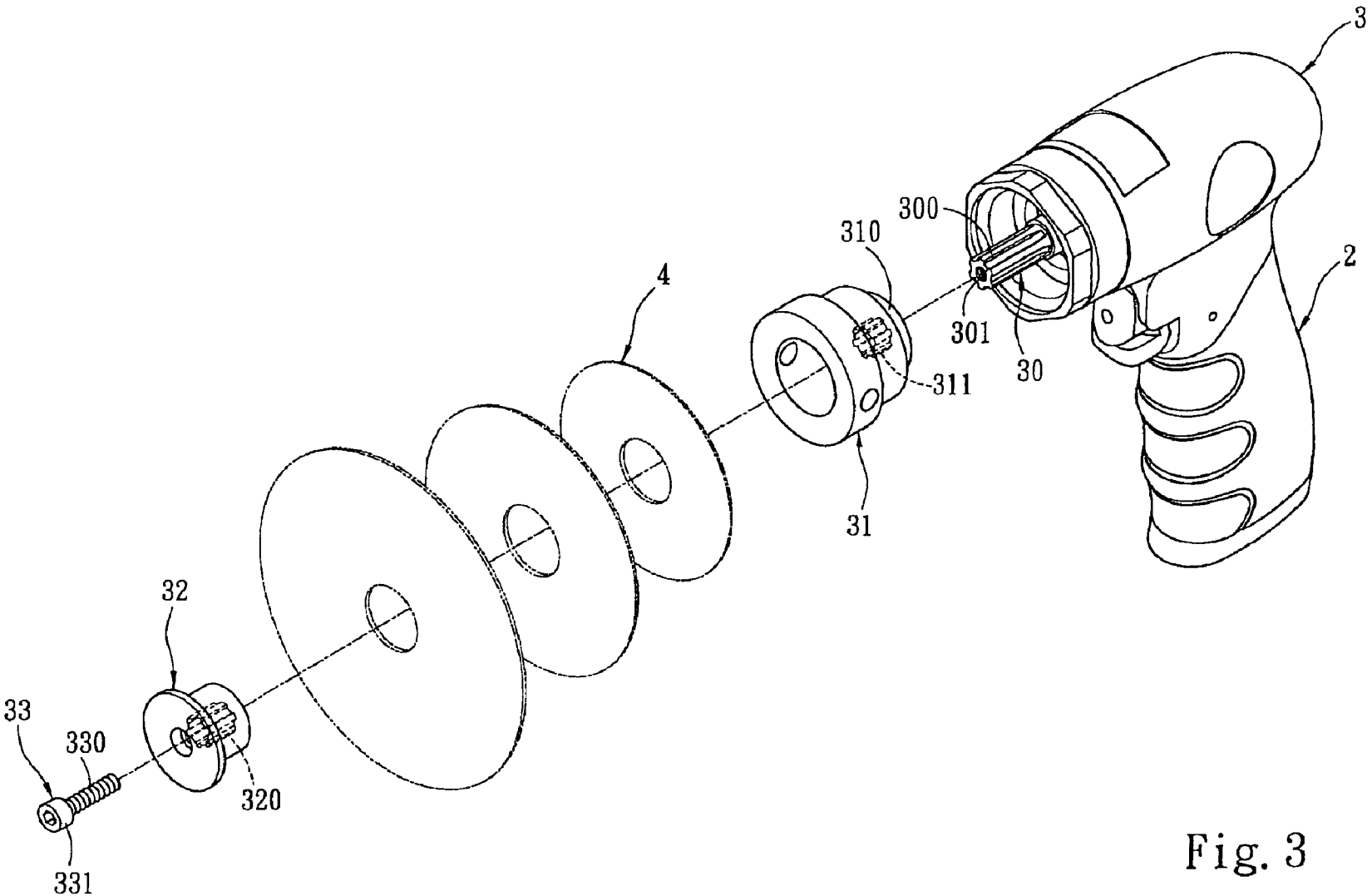
FIG. 3 is an exploded view of the present invention.
Figure 4:
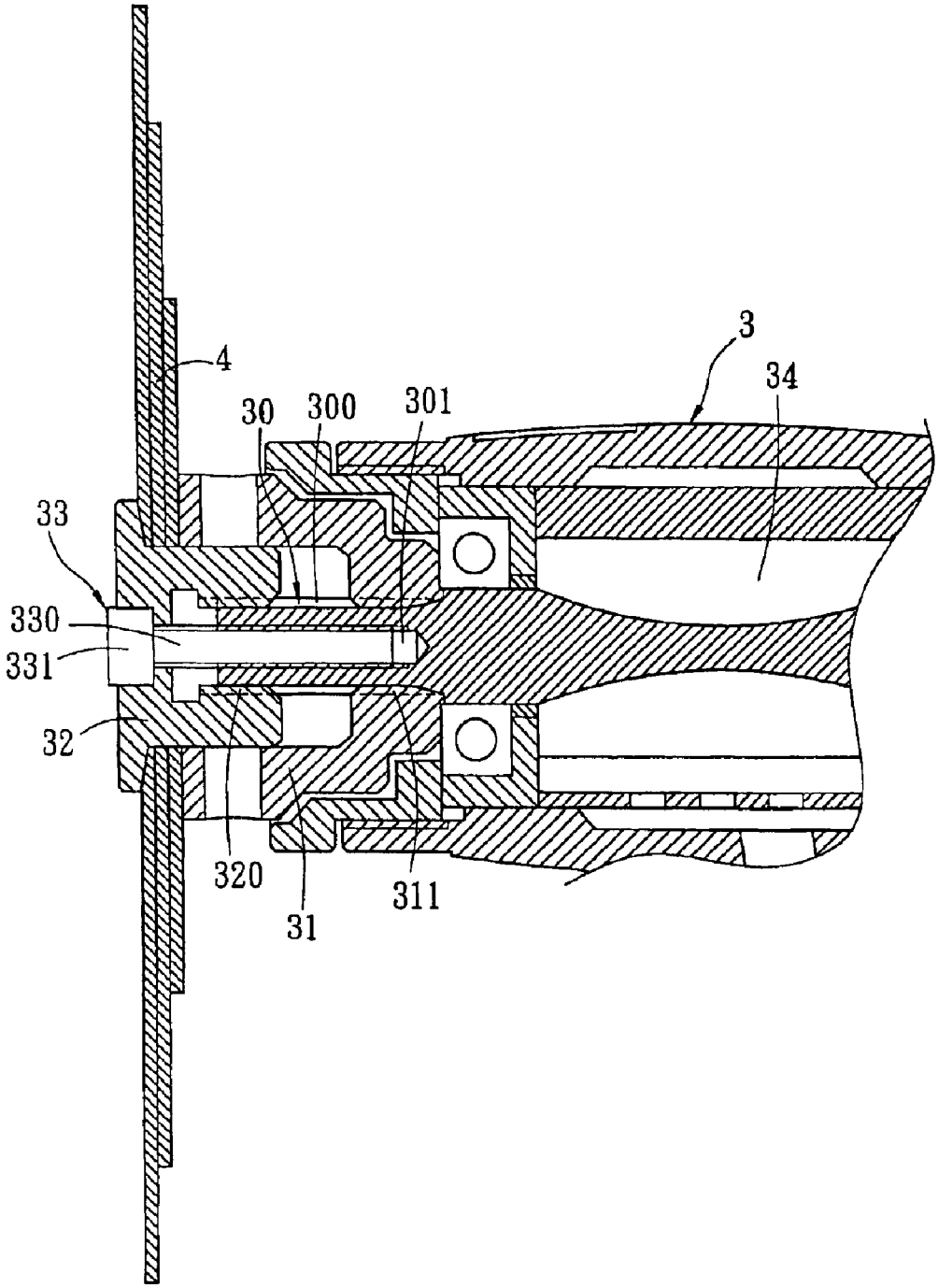
FIG. 4 is a fragmentary sectional view of the invention.

Please referring to FIGS. 2, 3 and 4, the bidirectional rotation pneumatic grinding tool according to present invention is adopted for use on surface treatment. It includes a grinding member 4, an operating section 3 and a handgrip 2. The operating section 3 includes:

an actuator 34 to drive a transmission axle 30 to rotate in two directions; the transmission axle 30 having a spline section 300 and a screw hole 301 formed in the spline section;

a coupling member 31 which has through openings on two ends; one end having a stepwise coupling section 310 with a first splined trough 311 formed therein to couple with the spline section 300 of the transmission axle 30;

a fastening member 32 which has through openings on two ends; one end having a second splined trough 320 formed on an inner wall and being insertable into the coupling member is 31 to couple with the spline section 300 of the transmission axle 30; and a fastening element 33 which has a compression section 331 on one end with screw threads 330 formed thereon to run through the fastening member 32 to fasten to the screw hole 301 of the transmission axle 30.

By means of the construction set forth above, the spline section 300 and the first and second splined troughs 311,320 may be coupled to enable the invention to rotate in the positive or inverse direction to meet different requirements without loosening off. The spline structure may be fabricated simply and assembled easily without concerning the direction of screwing occurred to the conventional techniques. And the sparks, grinding debris or dusts generated during grinding operation may be directed in a desired direction without polluting the working environment or hurting people or damaging the equipment.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A bi-directional rotation pneumatic grinding tool for surface grinding operation comprising an operating section and a handgrip, wherein the operating section includes:

an actuator to drive a transmission axle to rotate in two directions, the transmission axle having a spline section and a screw hole formed in the spline section;

a coupling member which has through openings on two ends, one end having a coupling section which has a first splined trough formed therein to couple with the spline section of the transmission axle;

a fastening member which has through openings on two ends, one end having a second splined trough formed on an inner wall and being insertable into the coupling member to couple with the spline section of the transmission axle; and a fastening element which has screw threads formed thereon to run through the fastening member to fasten to the screw hole of the transmission axle;

wherein forming and coupling of the spline section and the first splined trough and the second splined trough allows the transmission axle to rotate in a positive direction or an inverse direction as desired without loosening off and facilitates fabrication and assembly without concerning screw thread direction and sparks, grinding debris or dusts generated during grinding operation are allowed to be directed in a desired direction without polluting working environments or hurting people or damaging work pieces.

2. The bi-directional rotation pneumatic grinding tool of claim 1, wherein the coupling section is formed in a stepwise manner.

3. The bi-directional rotation pneumatic grinding tool of claim 1, wherein the fastening element has a compression section on one end.

* * * * *